United States Patent [19]

Melugin

[11] Patent Number: 4,734,059

[45] Date of Patent: Mar. 29, 1988

[54] IN-LINE FUSE HOLDER

[75] Inventor: Simeon A. Melugin, Capistrano Beach, Calif.

[73] Assignee: Lamcor, Inc., Anaheim, Calif.

[21] Appl. No.: 868,677

[22] Filed: May 30, 1986

[51] Int. Cl.[4] ..... H01R 13/68

[52] U.S. Cl. ..... 439/621; 337/201; 337/205

[58] Field of Search ..... 337/192, 201, 205; 339/147 R; 439/621, 622

[56] References Cited

U.S. PATENT DOCUMENTS

| | | | |
|---|---|---|---|
| 2,700,085 | 1/1955 | Breisch et al. | 337/201 |
| 2,839,636 | 6/1958 | Brown | 337/192 |
| 3,085,138 | 4/1963 | Brown et al. | 339/147 R |
| 3,843,050 | 10/1974 | Melugin | 337/201 |

*Primary Examiner*—Gil Weidenfeld
*Assistant Examiner*—Gary F. Pauman
*Attorney, Agent, or Firm*—Lyon & Lyon

[57] ABSTRACT

A moisture and waterproof seal for a fuse is provided while allowing selectively for fuse visibility enhancing non-breakability, and improved resistance against moisture ingress. The fuse holder includes flexible molded members which are formed with lips towards the ends remote to the fuse ends thereby allowing the lips to engage and envelope the fuse sealing against moisture. A cuff and groove formation leading the lips provides enhanced sealing of the molded parts. The members can be moved between a position exposing the fuse for visibility and the sealing position enclosing the fuse against breakage. Internal to the molded members are yieldable clips for engaging the end ferrules of the fuse.

14 Claims, 1 Drawing Figure

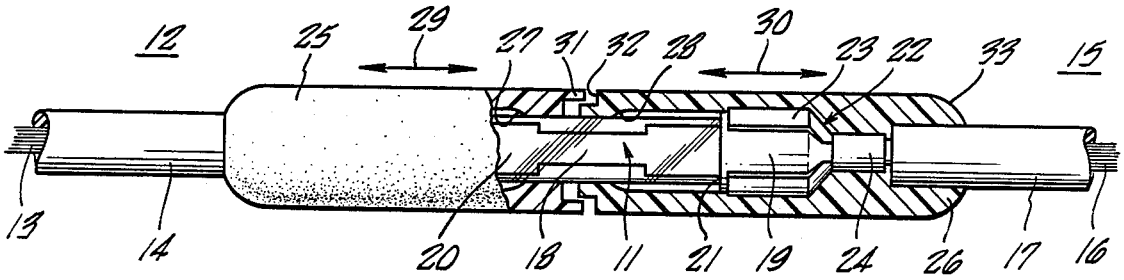
12
25
29
27
31
32
28
30
23
22
33
15
13
14
20
18
11
21
19
24
26
17
16

IN-LINE FUSE HOLDER

BACKGROUND OF THE INVENTION

This invention relates to in-line fuse holders.

More particularly, this invention relates to moisture and waterproof in-line fuse holders which allows selectively the visibility of a fuse wire while enhancing non-breakability of the fuse.

Previously, in-line fuses have been connected by conductive inserts which require a separate insulating member to prevent the conductive inserts from causing sparks or short circuits when the inserts come in contact with other conductive objects. The conductive inserts tend to deform and thus are rendered poor electrical contacts with repeated replacement of their associated fuse.

Other prior art devices include snap clip arrangements which are awkward and difficult to handle when replacing their associated fuses and also typically result in poor insulators.

Still further prior art arrangements which were adequate insulators do not provide for effective fuse wire visibility.

Thus, if an in-line fuse assembly is properly insulated, difficulties occur in either the replacement aspect, or the visibility aspect of the associated fuse.

One known in-line fuse holder which has overcome some of the above prior art drawbacks is the subject of U.S. Pat. No. 3,843,050 by the Applicant. Two molded members are provided for engagement with the respective conductive ends of the fuse. The fuse body extends and is visible between these molded members. While sealing the conductive elements is enhanced, the exposure of the fuse body renders it unnecessarily vulnerable to breakage.

Moreover, in certain marine applications it is necessary to provide fuses which have enhanced protection against possible moisture ingress.

SUMMARY OF THE INVENTION

An in-line fuse holder is formed which provides a moisture and waterproof seal for the conductive cap members or ferrules at each end of the fuse while allowing selectively for fuse visibility, enhancing non-breakability, and improved resistance to moisture ingress.

Molded flexible or pliable material is formed over the ferrule and its associated clip. Lips from the molded members remote from the fuse end directed inwardly, engage the fuse body to provide an insulating means to the fuse, and provide structure of enhanced stability and integrity and one that minimizes potential breakage of the fuse body. The molded members can be moved axially along the fuse body to selectively expose the fuse body or enclose the body against breakage. Lip and groove formations around the outside of the molded members facilitate the engaging sealing connections of the two molded members.

The in-line fuse holder provides a vacuum fit or seal which gives good insulation properties while allowing for replacement of the fuse by pulling the associated conductor or the molded members.

The invention is further described with reference to the following detailed description in conjunction with the accompanying drawing.

BRIEF DESCRIPTION OF THE DRAWING

The FIGURE is a side view partially in cross-section illustrating an exemplary embodiment of a fuse holder incorporating the invention.

DETAILED DESCRIPTION

An in-line fuse holder is electrically connected at a first end of a fuse 11 to a first conductor 12. The conductor 12 has an electrically conductive portion of single or multistrand wire 13 and an insulating portion 14 formed of materials well known in the art, and disposed about the wires 13. Likewise, the in-line fuse holder is electrically connected, at its second end to a second conductor 15 having an electrically conductive portion 16 and an insulating portion 17 disposed about the conductive portion 16.

The fuse 11 is of a standard design and includes a conductive fusable link or fuse wire 18 positioned between spaced ferrules or conductive end cap members, such as ferrule 19. The fuse wire 18 is disposed within a transparent fuse body 20 typically formed of glass, plastic or the like. The ferrule 19 is formed about the fuse 11 in a manner well known in the art and results in a rim 21 formed at the interface of the glass 20 and the ferrule 19. Alternately, the ferrule 19 may be formed with an outer depending flange or bead at the interface of the glass 20 and the ferrule 19.

The fusable link or fuse wire 18 allows electric current to flow through such wire without blowing or melting the wire while the electric current is below a selected or specific ampere rating such as 30 or 40 amps. Such fuse wire blows or melts when current above such selected or specified ampere rating flows through the wire. The sensitivity of the fuse wire, such as the length of time before blowing, may vary, depending on the various compositions and other factors well known to those skilled in the art.

The fuse wire or fusable link 18 may be electrically attached or connected to the conductive cap members or ferrules such as ferrule 19 of the fuse 11 by any manner well known in the art. Typical of such manners are spot welding or soldering of the fuse wire 18 directly to the ferrule 19.

Disposed about the ferrule 19 and frictionally engaging the outer surface of the ferrule 19 is a yieldable conductive clip insert or fuse end holder 22. Fuse end holder 22 may be of any well known construction as long as it utimately achieves proper electrical contact with the ferrule 19. The fuse end holder 22 is illustrated as comprising a yieldable circular flange portion 23 having a slot therein. The circular flange portion 23 has an inside diameter substantially the same or smaller than the outside diameter of the ferrule 19 in order to provide frictional engagement.

The fuse end holder 22 also includes crimpable portion 24 electrically coupled to the circular flange portion 23 and adapted to be crimpably disposed about the wires 16 in a manner well known in the art. The wires such as wires 16, typically are of a gauge such as a 14 gauge, but may be of any gauge depending upon the application of the fuse. The crimpable member 24 is typically pressed or crimped about the wires 16 to provide proper electrical and mechanical contact thereto. Alternately, a solder composition may be used to assure an electrical connection.

Insulating flexible molded members 25 and 26 are formed over a portion of the insulators 14 and 17 respectively. At the ends remote the fuse end ferrule 19, insulating members 25 and 26 provide internally directed lip portions 27 and 28 respectively which engage the fuse body 20 in a tight moisture and waterproofing engagement. In this manner, the cap rim, edge, border or bead 21 of the ferrule 19 is enveloped by the molded members 25 and 26 thereby providing a moisture and waterproof seal with the glass 20 of the fuse 11. The insulating members 25 and 26 are preferably formed by a process of injection molding, well known in the art, of a material which is relatively flexible or pliable so that the lip portions 27 and 28 are strong enough to provide a vacuum type seal with the fuse body 20. When the conductors 14 or 15 or the insulating members 25 or 26 are pulled apart from each other the fuse 11 can be removed allowing for replacement.

Insulating molded members 25 and 26 are slidable axially as indicated by arrows 29 and 30 allow substantially the entire glass body portion 20 of the fuse 11 to be selectively visible thereby making it readily apparent whether the conductive fusable link of fuse wire 18 is blown. By sliding the insulated molded members 25 and 26 apart from each other the fuse link 18 becomes visible. At the same time, the lips 27 and 28 sliding on the outside of the body portion 20 insure that the seal to the borders 21 is retained. Further, the insulating members 25 and 26 envelop all the conductive portions of the fuse 11 so that the possibility of sparking and/or shorting out is substantially eliminated.

At the ends of the molded members 25 and 26 adjacent the inwardly directed lips 27 and 28, there are provided an engaging circumferential cuff 31 and circumferential groove 32. The cuff 31 and groove 32 engage to enhance the sealability of the fuse 11 from moisture and water ingress. Moreover, the engagement of the cuff 31 and groove 32 provide enhanced rigidity to the combined molded members 25 and 26 thereby to enhance the protection of the fuse 11 against breakage.

The cuff 31 projects ahead of the inwardly directed lip 27, and the groove 32 is located substantially ahead of its respective lip 28. The axial length of the cuff 31 and groove 32 is about the same, or of less, axial length as the lips 27 and 29. By having relatively short axial lengths to the cuff 31 and groove 32 ease of assembly is possible, while still maintaining the other desirable characteristics of the seal. The lips 27, 28, cuff 31 and groove 32 extend for about 10% to 20% of the axial length of each molded member. This permits the effective sliding action on the glass or plastic of the fuse holder.

The insulating portions 14 and 17 formed about the conductors 12 and 15 may readily be provided with a sealant about the insulating portions 14 and 17 respectively to assure a liquid tight and secure fit at the remote end of the insulation members 25 and 26. However, a tapered portion 33 at the remote end of the insulating members 25 and 26 disposed about the conductors 12 and 15 provides a suitable frictional seal. Alternatively, the portion 33 may, upon being formed, be melted or bonded integrally with the insulation portions 14 and 17 to achieve added strength.

The lip portions 27 and 28 are formed so that its inside diameter is less than the outside diameter of the ferrule 19. Alternately, and preferably, the inside diameter of the lip 27 and 28 are less than that of the outside diameter of the glass portion 18 of the fuse 11. This enhances the sealing action of the insulating members 25 and 26 on the fuse 11.

In operation, when the insulating members 25 and 26 are molded over the conductor 12 and 15 respectively, and over the fuse end holders to engage the rim of the fuse end holders, the circular flange member 23 is prevented from being substantially deformed by repeated insertions and extractions of the ferrule of the associated fuses by the strength or resiliency of the molded members 25 and 26.

A suitable material for forming the insulating members 25 and 26, through the use of well known injection molding techniques, is polyvinyl chloride plastic compound. The insulating members 25 and 26 may also readily be formed from rubber, neoprene or other pliable plastic or rubber like material. Suitable candidates are semi-rigid vinyl, nylons, and teflons.

The fuse holder provides for effective electrical insulation as well as a moisture and waterproof seal. The fuse is selectively visible as required without detracting from the sealing properties of the holder with the fuse. The enhanced protection which the construction of the holder gives to the fuse is important in minimizing fuse breakage. With the ends of the resilient members providing lips for engaging the fuse body, and sliding on the fuse body as necessary between operative and non-operative positions enhanced integrity and security is imparted to the fuse holder. The fuse holder is reliable and secure, readily color coded and also allows for the easy replacement of fuses.

While an embodiment and application has been shown and described, it will be apparent to those skilled in the art that many more modificiations are possible without departing from the inventive concepts herein described. The invention is therefore, not to be restricted except by the appended claims.

I claim:

1. An in-line holder for a fuse having a conductive end portion coupled to a fuse holder body comprising:

a conductor having an electrically conductive portion and an insulating portion disposed about said electrically conductive portion;

a conductive fuse end holder having a first electrically conductive end connectable to said electrically conductive portion of said conductor, and a second electrically conductive end connectable to the conductive end portion of the fuse; and a first flexible member disposed about a part of said insulating portion of said conductor, and about said conductive fuse end holder and about the entire conductive end portion of the fuse, said first flexible member having:

an aperture for the insertion of a portion of the fuse including the conductive end portion in electrical and mechanical contact with said fuse end holder;

a resilient inwardly directed portion for engaging the fuse body to provide a moisture seal to the conductive end portion of the fuse, said inwardly directed resilient portion being spaced remotely from the conductive fuse end holder; and a second flexible member about a second end of the fuse having an aperture at one end and also a conductive fuse end holder attached to a conductor, and wherein the ends of the respective flexible members remote from their respective fuse end holders provide engaging circumferential cuff and groove formations for enhancing the sealability to the fuse, and said second flexible member provides a resilient inwardly directed portion for engaging the fuse, with said first and second flexible members being selectively movable between a position wherein the fuse is substantially covered thereby, and a withdrawn position wherein the fuse is at least partly visible, the moisture seal being retained in both positions.

2. The holder claimed in claim 1 wherein said resilient inwardly directed portions of said first and said second flexible members are lips having an inner diameter less than the outer diameter of the conductive end portion of the fuse.

3. The holder claimed in claim 2 wherein said resilient lips have inner diameters less than the outer diameter of the fuse body thereby forming a vacuum seal with the fuse body.

4. The holder as claimed in claim 3, wherein the cuff and groove formations are located substantially ahead of the inwardly directed portions, such cuff and groove being substantially as axially coextensive as the inwardly directed portions.

5. The holder as claimed in claim 4 wherein the cuff and groove extends between about 10% to 20% of the axial length of the flexible member.

6. The holder as claimed in claim 5 wherein the inwardly directed portions extend about 10% to 20% of the axial length of the flexible member whereby sliding action on the fuse body is facilitated.

7. The holder as claimed in claim 6 wherein said flexible members include a means remote from the lip and groove formations for engaging a part of said insulating portion of said conductor.

8. The holder as claimed in claim 7 wherein said flexible member substantially prevents the outward deformation of said fuse end holder means.

9. The holder as claimed in claim 8 wherein said fuse end holder means includes a circular flange means disposed about the end portion of the fuse and in electrical contact therewith, and a crimping means electrically connected to said circular flange means for providing electrical and mechanical connection to the electrically conductive portion of said conductor.

10. The holder as claimed in claim 9 wherein the flexible member is a molded member.

11. The holder as claimed in claim 10 wherein the flexible molded member is injected molded.

12. The holder as claimed in claim 11 wherein the flexible molded member is formed of polyvinyl chloride.

13. The method of forming an in-line fuse holder comprising the steps of:

electrically connecting first and second fuse end holders each to an electrically conductive portion of first and second conductors, respectively, and molding an insulating flexible member about each of the fuse end holders and about an insulating portion of each conductor thereby forming in each flexible member an aperture for receiving a conductive end cap member of an associated fuse having a fuse body and a rim thereon at the border of the cap member and the fuse body, an inwardly directed lip of each molded member remotely located from its respective fuse end holder adjacent the conductor releasably engaging the fuse body thereby providing an insulated moisture proof seal to the rim for the fuse; and providing for selectively sliding the first and second flexible members between positions where the fuse is substantially covered by the first and second flexible members and a withdrawn position where the fuse is at least partly visible, the moisture seal being retained in both positions.

14. The method as in claim 13 including the step of bonding the molder member with a part of the insulating portion of the conductor.

* * * * *